US009279284B1

(12) United States Patent
Axelrod et al.

(10) Patent No.: US 9,279,284 B1
(45) Date of Patent: Mar. 8, 2016

(54) FOOT OPERATED PET GATE

(71) Applicant: T.F.H. PUBLICATIONS, INC., Neptune City, NJ (US)

(72) Inventors: Glen S. Axelrod, Colts Neck, NJ (US); Ajay Gajria, Maharashtra (IN)

(73) Assignee: T.F.H. PUBLICATIONS, INC., Neptune City, NJ (US)

( * ) Notice: Subject to any disclaimer, the term of this patent is extended or adjusted under 35 U.S.C. 154(b) by 0 days.

(21) Appl. No.: 14/518,357

(22) Filed: Oct. 20, 2014

(51) Int. Cl.

| | |
|---|---|
| ***E05C 1/10*** | (2006.01) |
| ***E06B 3/36*** | (2006.01) |
| ***E06B 7/32*** | (2006.01) |
| ***E05F 13/00*** | (2006.01) |
| ***E05F 11/54*** | (2006.01) |
| ***E06B 11/02*** | (2006.01) |

(52) U.S. Cl.
CPC . *E06B 7/32* (2013.01); *E05F 11/54* (2013.01); *E05F 13/00* (2013.01); *E06B 11/02* (2013.01)

(58) Field of Classification Search
CPC ..... E06B 7/32; E06B 11/02; E06B 9/04; E06B 2009/002; E05F 11/54; E05F 13/00; E05B 53/001; E05B 65/0007; E05B 65/0014
USPC ..... 49/55, 57, 394, 463; 292/255
See application file for complete search history.

(56) References Cited

U.S. PATENT DOCUMENTS 533,571 A 2/1895 Tower
2,120,534 A * 6/1938 Wild ..... E05B 53/001 292/170
4,068,872 A * 1/1978 Smith ..... E05B 53/001 292/255
4,621,848 A * 11/1986 Pierce ..... E05B 53/001 292/166
4,944,117 A 7/1990 Gebhard et al.
5,193,863 A * 3/1993 McBain ..... E05B 53/001 292/255
5,217,265 A * 6/1993 Lerner ..... E05B 37/163 292/196
5,396,732 A 3/1995 Andersen
5,809,694 A * 9/1998 Postans ..... E05B 65/0007 292/207

(Continued)

FOREIGN PATENT DOCUMENTS

| | | |
|---|---|---|
| EP | 1331352 | 7/2003 |
| GB | 2041051 | 9/1980 |

(Continued)

OTHER PUBLICATIONS

International Search Report and Written Opinion from related PCT Appln. No. PCT/US2015/056149, dated Jan. 12, 2016.

*Primary Examiner* — Katherine Mitchell
*Assistant Examiner* — Justin Rephann
(74) *Attorney, Agent, or Firm* — Grossman, Tucker, Perreault & Pfleger, PLLC

(57) ABSTRACT

A pet gate and method of operating thereof. The gate including a frame including first and second vertical side members; a door pivotally mounted to the second vertical side member. The door includes a pole extending between upper and a lower door crossbars, wherein the door pivots between an open position and a closed position. A foot actuator is mounted to the door and is vertically slidable between a raised position and a lowered position. A first channel in the foot actuator aligns with the pole and receives a drive that passes through the pole. The drive is raise-able by the foot actuator. A retractable bar is slidably provided in the upper door crossbar. The drive engages the retractable bar when the drive is raised. An upper retracting pin extends from the retractable bar and is receivable in a upper catch provided in the first vertical member.

18 Claims, 9 Drawing Sheets

(56) References Cited

U.S. PATENT DOCUMENTS

| | | | | |
|---|---|---|---|---|
| 5,975,593 | A * | 11/1999 | Cress | E05B 53/001 292/101 |
| 6,176,042 | B1 * | 1/2001 | Rossman | A01K 1/0017 160/210 |
| 6,370,823 | B1 | 4/2002 | Andersen | |
| 6,446,395 | B2 * | 9/2002 | Rogers | E06B 9/04 160/215 |
| 6,499,254 | B2 | 12/2002 | Rossman et al. | |
| 7,270,352 | B1 * | 9/2007 | Stuart | E05B 1/0053 292/255 |
| 7,334,624 | B2 * | 2/2008 | Waldman | E05B 17/2053 160/144 |
| 7,373,755 | B2 | 5/2008 | Jefferys et al. | |
| 7,540,046 | B1 * | 6/2009 | Lai | A47D 13/065 256/26 |
| 7,627,985 | B2 * | 12/2009 | Marsden | E05B 65/0014 49/394 |
| 7,874,103 | B2 | 1/2011 | Yates | |
| 8,347,555 | B2 | 1/2013 | Chen | |
| 8,607,502 | B2 | 12/2013 | Flannery et al. | |
| 8,615,928 | B2 * | 12/2013 | Wang | E04H 17/00 49/226 |
| 8,745,922 | B1 * | 6/2014 | Matsuda | A01K 1/0017 49/236 |
| 2001/0000556 | A1 | 5/2001 | Rossman et al. | |
| 2003/0009945 | A1 * | 1/2003 | Cheng | E05F 1/063 49/57 |
| 2010/0293861 | A1 * | 11/2010 | Ting | E05B 47/026 49/394 |
| 2011/0175046 | A1 | 7/2011 | Flannery et al. | |
| 2011/0225890 | A1 | 9/2011 | Greenwood et al. | |
| 2012/0324792 | A1 * | 12/2012 | Bertsch | E06B 9/04 49/37 |
| 2013/0125470 | A1 * | 5/2013 | Dunn | E06B 9/04 49/381 |
| 2013/0227888 | A1 | 9/2013 | Nur-Tegin | |
| 2015/0027060 | A1 * | 1/2015 | Sousa | E06B 9/04 49/394 |
| 2015/0259964 | A1 * | 9/2015 | Linehan | E05F 13/00 49/272 |

FOREIGN PATENT DOCUMENTS

| | | |
|---|---|---|
| GB | 2216939 | 10/1989 |
| GB | 2271603 | 4/1994 |
| JP | 2007182738 | 7/2007 |
| WO | 2005/024167 | 3/2005 |

* cited by examiner

FOOT OPERATED PET GATE

FIELD

The present disclosure is directed to a foot operated pet safety gate. In embodiments, the gate may also be operated by hand.

BACKGROUND

Barriers are often used to keep pets, or their owners, safe by preventing pets from being exposed to or creating hazards. For example, if a pet has a tendency to get into a trash bin a barrier may be erected to keep the pet away from the trash bin. Or, if a pet has a tendency to knock over a toddler or the toddler has a tendency to pull at the pet, the pet and toddler may be kept in separate areas by erecting a barrier between the pet and the toddler.

Gates are commonly used as barriers within a home. Gates provide a barrier that is not as obstructive as a door and requires relatively little effort to position within a passageway as compared to erecting a wall or a door. A gate may generally include a frame that mounts the gate in a passageway. A door is mounted in the gate frame allowing access through the passageway. Often the door is unlatched from the frame using a hand operated actuator. However, this arrangement may not be convenient if one needs to pass through the gate carrying a number of items in their hands. Accordingly, room remains for improvement in the structure and operation of a gate to allow one passing through a gate to conveniently open the gate without the use of their hands.

SUMMARY

An aspect of the present disclosure relates to a pet gate. The pet gate includes a frame, which includes a first vertical side member and a second vertical side member. The pet gate also includes a door pivotally mounted to the second vertical side member, wherein the door includes a pole extending between an upper door crossbar and a lower door crossbar, and the door pivots between an open position and a closed position. The pet gate further includes a foot actuator mounted to the door, wherein the foot actuator is vertically slidable between a raised position and a lowered position. A first channel is provided in the foot actuator, wherein the first channel aligns with the pole. A drive passes through the pole and is received in the first channel, wherein the drive is raise-able by the foot actuator. In addition, the pet gate includes a retractable bar slidably provided in the upper door crossbar, wherein the drive engages the retractable bar when the drive is raised. An upper retracting pin extends from the retractable bar, wherein the upper retracting pin is receivable in an upper catch provided on the first vertical member.

Another aspect of the present disclosure relates to a method of opening a gate. The method includes raising a foot actuator slidably mounted to a door, wherein the door comprises a pole extending between an upper crossbar and a lower crossbar and the door is pivotably mounted in a frame. The frame includes a first vertical member and a second vertical member. The method also includes engaging a drive with the foot actuator and raising the drive, wherein the drive extends through the pole. The method further includes sliding a retractable bar away from the first vertical member with the drive, wherein the retractable bar includes an upper retracting pin. The upper retracting pin is removed from an upper catch in the first vertical member and the door may then be pivoted door relative to the second vertical member.

In yet a further aspect, the present disclosure relates to a method of opening a gate. The method includes depressing an actuator button in a hand actuator affixed to a door, wherein the door comprises a pole extending between an upper crossbar and a lower crossbar, and the door is pivotably mounted in a frame including a first vertical member and a second vertical member. The method also includes sliding a retractable bar away from the first vertical member with the actuator button and removing an upper retracting pin affixed to the retractable bar from an upper catch in the first vertical member. The method further includes raising an actuation lever at least partially into the hand actuator, raising a drive with the actuation lever, wherein the drive includes a lower retracting pin, and raising the lower retracting pin out of a lower catch in the frame.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

The present disclosure is directed to a foot operated safety gate. The gate is operable without the use of a user's hands. In embodiments, the safety gate may also be opened using hand activated latch. The gate includes a mounting frame and a door, which pivots from a closed, latched position to an open, unlatched position. In the closed position people or pets are prevented from passing through and in an opened position people and pets may pass through.

Figure 1:
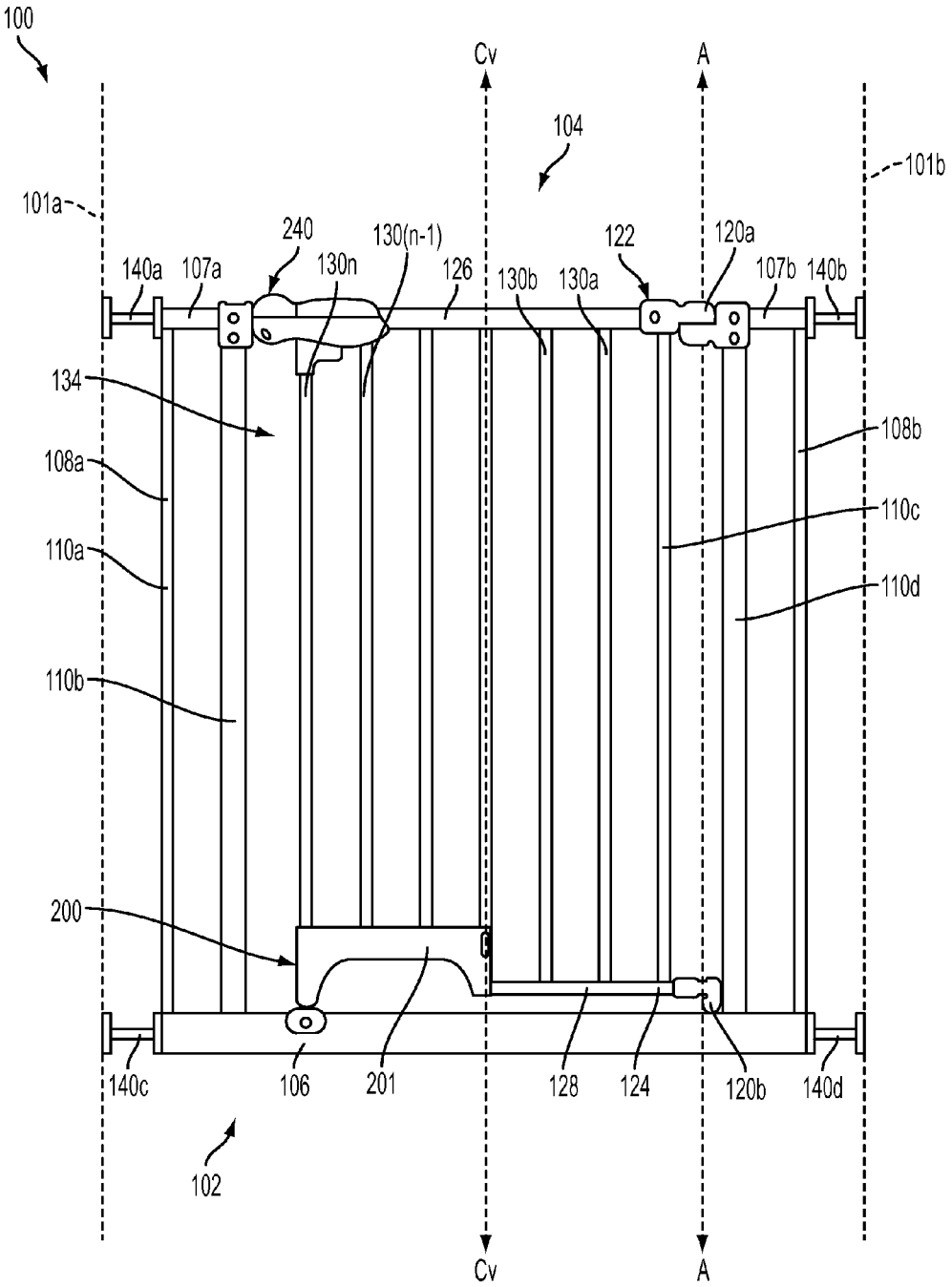
FIG. 1 illustrates a front view of an embodiment of a foot operated gate in the latched position.
Figure 2:
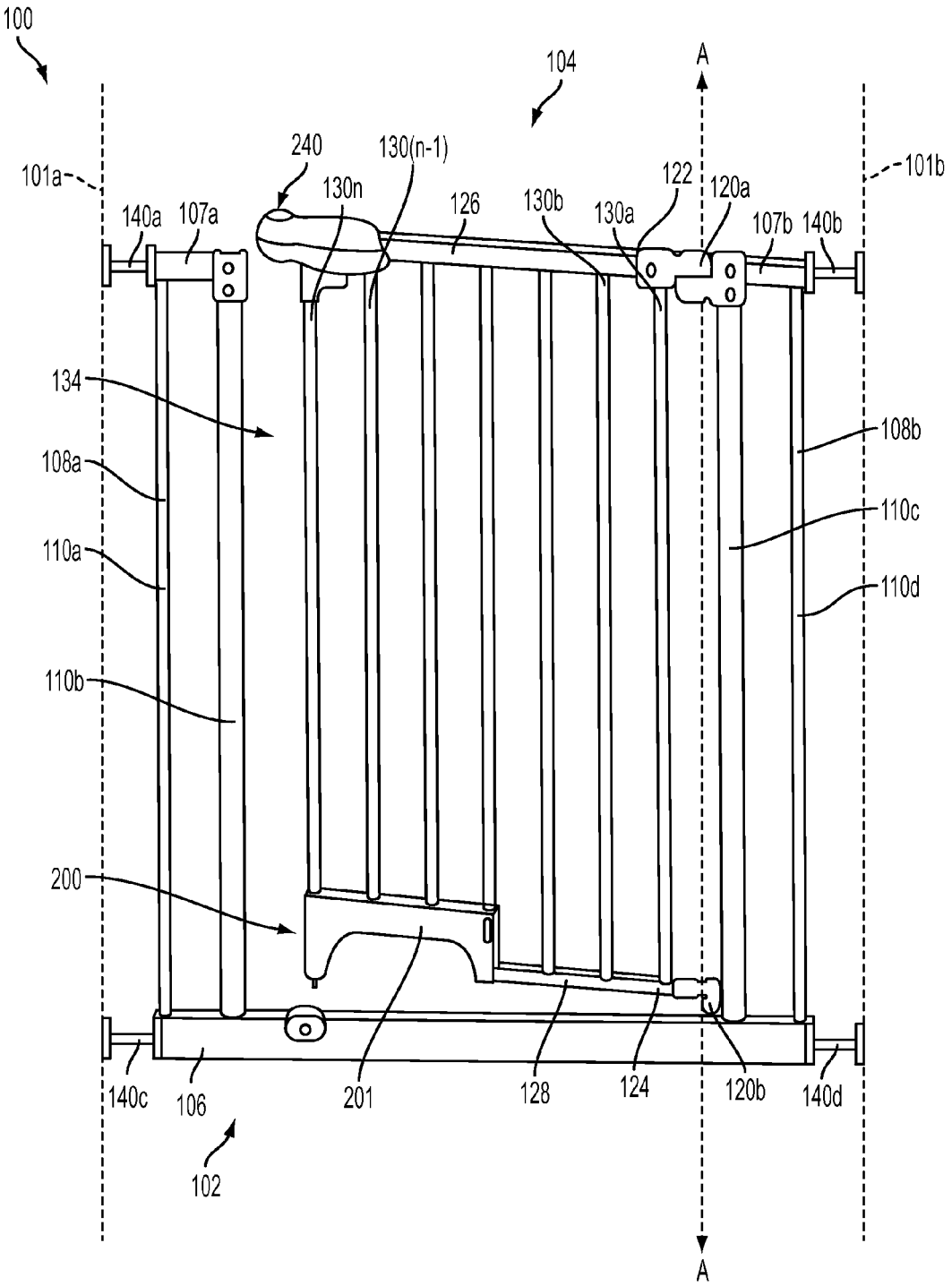
FIG. 2 illustrates a front view of an embodiment of the foot operated gate of FIG. 1 in the unlatched position.

FIGS. 1 and 2 illustrate an embodiment of a gate 100, wherein FIG. 1 illustrates the gate 100 latched in the closed position and FIG. 2 illustrates the gate 100 unlatched and in the open position. The gate 100 includes a frame 102 and a door 104. The frame 102 secures the gate 100 between two vertical surfaces 101*a*, 101*b*, such as walls or a door jamb, and the door 104 is pivotably mounted within the frame 102. In the closed position, the gate spans the frame forming a barrier preventing the passage of a person or pet through the gate. In the open position, the frame provides an opening for a person or pet to pass through the gate. In embodiments, the door 104 may pivot in either direction relative to the frame or may swing in only one direction. The gate door 104 may exhibit a vertical center line $C_V$, which may be referred to further herein as a point of reference. Further, while it is illustrated that the vertical surfaces 101*a*, 101*b*, to which the gate 100 is mounted oppose each other, other arrangements are contemplated and are described further herein.

The frame 102 forms a jamb for the gate door 104 and may include a lower frame crossbar 106 spanning the length of the gate 100 and two vertical side members 108*a*, 108*b* on either side of the gate door 104 extending up from the lower frame crossbar 106. The vertical side members are illustrated as being formed from vertical poles 110*a*, 110*b*, 110*c*, 110*d* retained by the lower cross bar 106 and an upper crossbar 107*a*, 107*b* and forming openings between the poles and crossbars. However, panels may alternatively be used as vertical side members 108*a*, 108*b*. In embodiments, the portion of the lower frame crossbar 106 extending across the bottom of the gate 100 underneath the door 104 may not be present, wherein the vertical side members 108*a*, 108*b* are mounted independently to the vertical surfaces 101*a*, 101*b* which the gate spans.

As illustrated the poles are secured directly to the crossbars; however, other configurations may be contemplated, where the poles may be mounted diagonally, horizontally or combinations of one or more of vertically, diagonally and horizontally. The poles may be spaced apart between 1 to 3 inches, including all values and ranges therein, such as 1.5 inches, 2.0 inches, 2.5 inches, etc., at 0.25 inch increments. Pole spacing may depend upon the size of pet for which the barrier is intended. Further, the poles may assume a number of cross-sectional geometries, such as rectangular, elliptical, circular, oblong, square, or triangular. The poles may individually be solid or hollow.

As alluded to above, the gate door 104 may be pivotally connected to one of the vertical side members 108*b* of the frame 102. As illustrated two hinged couplings 120*a*, 120*b* are attached between the door 104 and the frame. The hinged couplings may include a first portion and a second portion that rotate relative to each other. As illustrated in FIGS. 1 and 2, a first coupling 120*a* is attached at the upper corner 122 of the door 104 as well as an upper corner of the vertical side member 108*b* and a second coupling is attached at the lower corner 124 of the door 104 as well as the crossbar 106 near a lower portion of the vertical side member 108*b*. Alternatively, one, three or more hinged couplings may be provided between the door 104 and the frame 102 anywhere between the upper and lower portions of the door 104. The hinged couplings allow the door 104 to pivot from a closed position to an open position around axis A-A, relative to the vertical side member 108*b* to which the gate is attached. In embodiments, the hinged couplings may be biased shut, returning the gate door 104 to the closed position from the open position and requiring the application of a force overcome the bias of the couplings to swing the door 104 open.

The door 104 may be retained in a latched position by retracting pins discussed further herein. In addition, mechanical stops may be provided to prevent the gate from rotating to the point where the gate interferes with the surfaces to which the gate may be mounted or to prevent the gate from swinging in both directions. Such stops may be mounted to the frame or the door at various locations.

The gate door 104 may include an upper door crossbar 126 and one or more lower door crossbars 128. At least one pole, such as poles 130*a*, 130*b* (and so on to 130*n*) may be secured between the upper door crossbar 126 and lower door crossbar 128. As illustrated the poles are secured directly to the crossbars. However, similar to the frame 102 other configurations may be contemplated, including indirectly coupling the poles to the crossbars or mounting the poles diagonally, horizontally or combinations of two or more of vertical, diagonal and horizontal mountings. The poles may be spaced apart between 1 to 3 inches, including all values and ranges therein, such as 1.5 inches, 2.0 inches, 2.5 inches, etc., at 0.25 inch increments. Pole spacing in the gate, frame or both may depend upon the size of pet for which the barrier is intended. Further, the poles may assume a number of cross-sectional geometries, such as rectangular, elliptical, circular, oblong, square, or triangular. The poles may individually be hollow or solid. The crossbars and poles forming the gate may be formed from a variety of materials. One or more materials may be used in a single gate to provide various aesthetic qualities. In embodiments, the materials used may include wood, metal and alloys thereof, plastic or combinations two or more of the above.

The gate 100 may be retained between two vertical surfaces 101*a*, 101*b* by biasing the gate between the vertical surfaces 101*a*, 101*b* or by affixing the gate to the vertical surfaces 101*a*, 101*b*. In one embodiment, the gate 100 may be retained in place between two opposing surfaces by biasing the gate 100 against the surfaces using holding assemblies. As illustrated in FIGS. 1 and 2, the holding assemblies 140*a*, 140*b*, 140*c*, 140*d* may be positioned at each corner of the gate, extending out from the vertical surfaces of the gate. It is contemplated that the holding cups may be positioned at other locations around the periphery of the gate, including at various horizontal and vertical positions around the periphery of the gate.

Figure 3A:
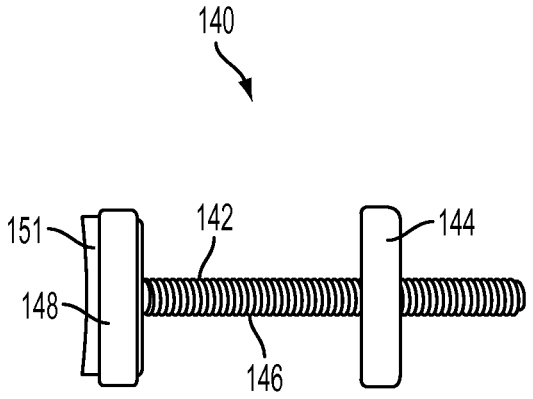
FIG. 3*a* illustrates an embodiment of a holding assembly for securing a gate to a vertical surface.
Figure 3B:
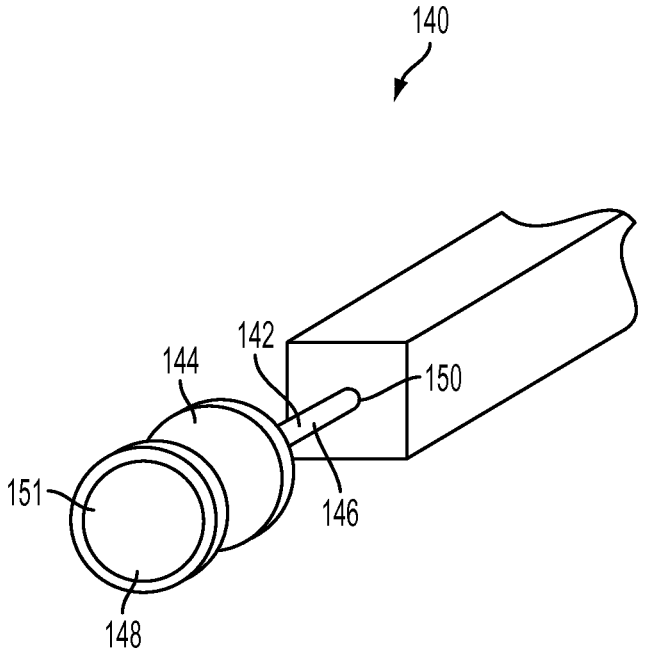
FIG. 3*b* illustrates perspective view of an embodiment of the holding assembly of FIG. 3*a* when inserted into a gate frame.

FIGS. 3*a* and 3*b* illustrate an embodiment of a holding assembly and its deployment. FIG. 3*a* illustrates an embodiment of a holding assembly 140, which includes an adjustment bolt 142 and an adjustment knob 144. The adjustment bolt 142 includes an externally threaded shank 146 and a bolt head 148. The adjustment knob 144 includes internal threads that mate with the external threads of the shank. The adjustment knob 144 may be rotated relative to the shank, or vice versa, to move the adjustment knob 144 back and forth along the length of the threaded shank 146.

The holding assembly 140 is retained in the gate 100 by feeding the threaded shaft 146 through an opening 150 in the gate, as seen in FIG. 3*b*. In embodiments, the opening 150 may have a diameter that is smaller than the diameter of the threaded shank, providing an interference fit between the shank and the opening. Alternatively or in addition, the opening 150 may include internal threads that mate with the external threads of the threaded shank 146. Holding cups or adhesive pads 151 may be mounted to the head 148 of the adjustment bolt 142. In alternative embodiments, instead of the holding assembly above described, a mounting plate may be secured to the vertical surface to which the gate is affixed. A retention pin may be retained by both the mounting plate and the opening 150 of the gate suspending the gate. Other alternative methods of attaching the gate to vertical surfaces may be contemplated herein as well.

In one embodiment, when mounting the gate against the vertical surfaces 101*a*, 101*b*, the adjustment bolt heads may be extended to the vertical surface and the adjustment knobs 144 may be rotated towards the gate 100 to secure the gate in place. In another embodiment, the adjustment knob 144 may be retained in place against the gate 100 and the adjustment bolt 142 may be rotated relative to the adjustment knob 144 extending the adjustment bolt out 142 to the vertical surface.

Figure 4A:
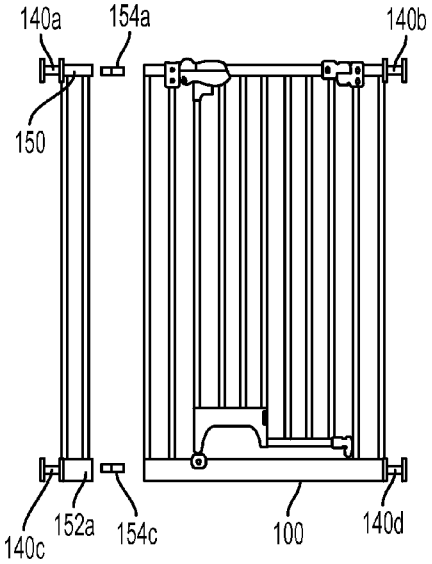
FIG. 4*a* illustrates an embodiment of a gate including an extension.
Figure 4B:
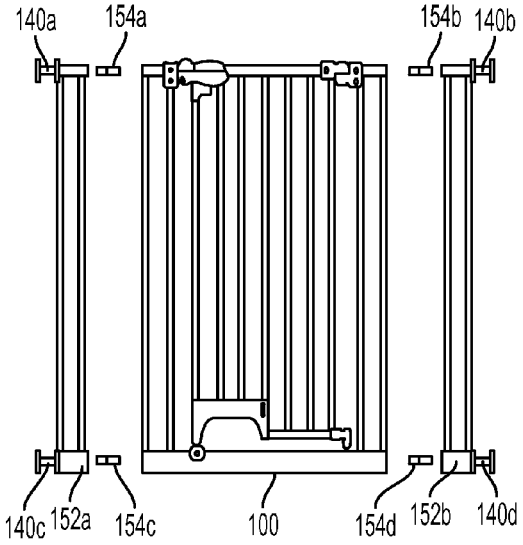
FIG. 4*b* illustrates an embodiment of a gate including two extensions on either side of the gate.

Referring again to FIGS. 1 and 2, as noted above, the gate 100 may be mounted between two vertical surfaces 101*a*, 101*b*, such as between two walls, the jamb of a door, railings of a stairwell, or a combination thereof. The gate 100 may be sized to block the passageway formed between the two surfaces. Additional vertical side members, i.e., extensions 152*a*, 152*b* may also be provided as illustrated in FIGS. 4*a* and 4*b*. The extensions 152*a*, 152*b* may be mounted on one or both sides of the gate 100. Mechanical attachments may be used to hold the extensions to the gate, such as through the use of retention pins 154*a*, 154*b*, 154*c*, 154*d* that are received in the mounting cup spindle openings. If employed, the adjustment shafts (see 146 of FIGS. 3*a* and 3*b*) of the holding assemblies 140*a*, 140*b*, 140*c*, 140*d* may then be placed in openings 150 in the gate extensions 152*a*, 152*b* opposing the retention pins. While the extensions are illustrated as being formed by lower and upper crossbars and vertical poles forming openings therebetween, panels may alternatively be provided. Other mechanical attachments between the extensions 152*a*, 152*b* and the gate 100 may alternatively be used, such as nuts and bolts, screws, or interlocking features extending from the gate and extensions.

Again, as illustrated in FIGS. 1 through 3, the two vertical surfaces 101*a*, 101*b* may oppose each other, such as in a hallway. However, situations may arise where two opposing surfaces are not available for mounting a gate. In such situations, the gate may be mounted between two surfaces that may be at an angle to each other, such as perpendicular to each other. Angled or hinged gate extensions may be provided as well to allow for various configurations of the gate and mounting the gate to vertical surfaces.

The gate may include a latching mechanism for retaining the gate in the closed position and for releasing the gate to swing open. Reference is made to FIGS. 1 and 2, the locking mechanism includes a foot actuator 200 located at the lower portion of the gate and optionally a hand actuator 240 located at the upper portion of the gate. The foot actuator may be operated without using the hand actuator and the hand actuator may be operated without using the foot actuator.

Figure 5:
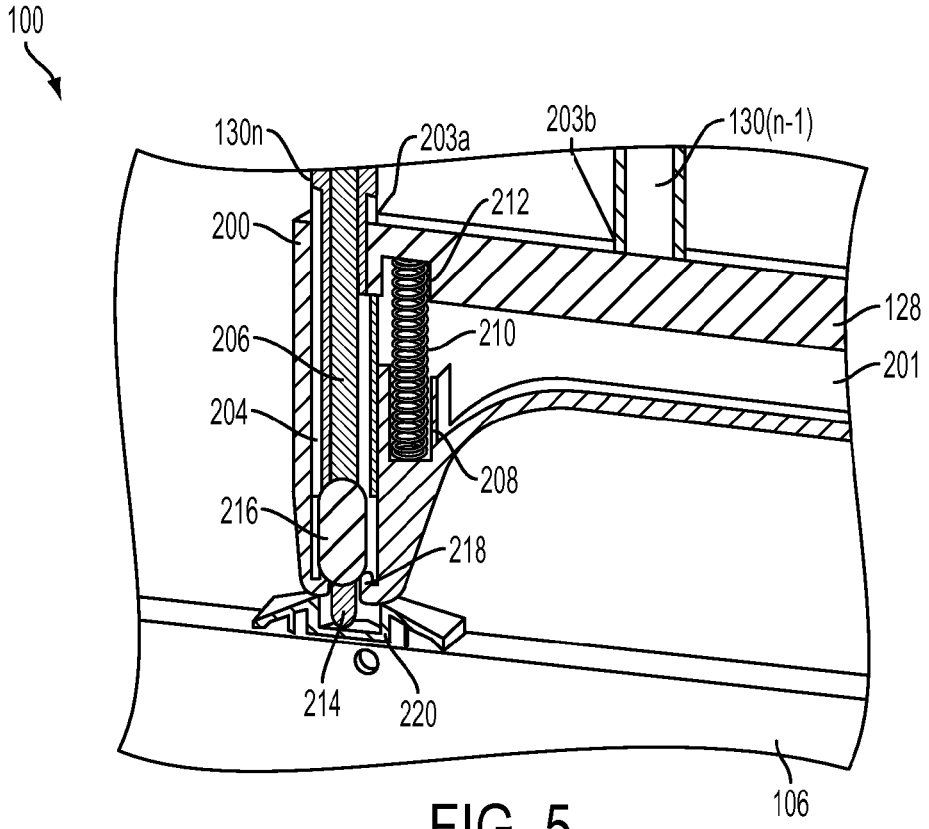
FIG. 5 illustrates an embodiment of the foot actuator with the front portion of the actuator cover removed with the actuator in the neutral, latched position.

The foot actuator 200 may include a cover 201 generally exhibiting an upside down "U" shape with sufficient clearance for a user's foot to pass through between the lower frame crossbar 106 and the foot actuator 200. Other shapes may be contemplated as well, such as an "L" shape. FIG. 5 illustrates a cross-section of the lower portion of the gate 100 seen in FIGS. 1 and 2. The foot actuator cover 201 covers a portion of the lower door crossbar 128 and corresponding poles 130*n*, 130(*n*−1). In embodiments, the lower door crossbar 128 may be provided in two sections, a first section that is spaced vertically higher relative to the second section to which the foot actuator is attached. Or the lower door crossbar 128 is bent to accommodate the foot opening. Openings 203*a*, 203*b* in the top of the foot actuator cover 201 accommodate the poles 130*n*, 130(*n*−1) extending up from the lower gate crossbar 128 and slides upon and down on the poles 130*n*, 130(*n*−1). Thus, the foot actuator is slidably mounted to the door and may be positioned in a raised position or a lower position, but generally remains in the lower position when force is not applied.

The foot actuator cover 201 includes a first vertical channel 204, which is aligned with a vertical pole, such as pole 130*n*. The channel may be molded into the cover or the channel may be formed later by machining it into the cover, or by affixing a separate piece into the cover. A drive 206 may be positioned through the pole 130*n* and positioned within the first vertical channel 204. The drive 206 may then be raised and lowered within the first channel 204 and pole 130*n* to latch and unlatch the door. While the drive 206 is illustrated as extending through the last pole 130*n* of the gate door 104 (opposing the side of the door that is affixed to the frame), the drive 206 may alternatively extend through any other vertical pole in the door, such as the next to the last pole 130(*n*−1). The foot actuator cover 201 also includes a second vertical channel 208 for receiving a biasing spring 210, which holds the foot actuator 200 in the downward position.

As illustrated, the drive 206 includes a lower retracting pin 214 at the end of the drive 206 near the bottom of the door 104. The lower retracting pin 214 protrudes from the bottom of the gate door 104 and is received in a lower catch 220 located in the frame 102 on the frame crossbar 106. The catch 220 is illustrated as a ramped cup secured to the upper surface of the frame crossbar 106. Alternatively, the catch may include an opening in the lower frame crossbar 106 to receive the lower retracting pin 214 and, may optionally include a cup for receiving the lower retracting pin 214 that may be at least partially, if not completely, recessed within the opening in the frame crossbar 106.

The drive 206 may also include a collar 216 positioned above the retracting pin 214. The collar 216 may exhibit a diameter or thickness that is larger than either the retracting pin 214, the drive 206, or both. While the collar 216 is illustrated as encircling the entire drive 206, the collar may encircle only a portion of the drive 206. Or, breaks may be provided in the collar 216. The collar 216 may rest on a lip 218 provided in the base of the actuator cover 201. In embodiments, the lip 218 may be formed in the cover (as illustrated) or affixed to the cover. Like the collar 216, the lip may encircle the entire drive 206, or a portion of the drive 206, provided that the lip 218 is at least partially coextensive with the collar 216. When the actuator 200 is raised, the lip 218 may apply an upward force to the collar 216 raising the drive 206 and retracting the lower retracting pin 214 out of the catch 220.

As the weight of the drive applies a downward force on lip 218 of the foot actuator 200, the drive 206 may be of a weight so that an animal may not easily raise the foot actuator 200. That is, the drive may be 1 ounce or more, including all values and ranges therein from 1 ounce to 30 pounds, such as in the range of 5 pounds to 30 pounds, including all values and ranges therein. The weight may be selected based upon the pet that the gate is intended for.

A first bias spring 210 may be received in the second channel 208 in the foot actuator 200 and a recess 212 in the lower door crossbar 128 and may therefore be retained between said foot actuator and said lower door crossbar. The bias spring 210 maintains the foot actuator 200 in the downward position relative to the lower gate crossbar 128 as seen in FIG. 5. In addition to, or alternatively to the weight of the drive 206, the force required to overcome the bias force of the spring, i.e., the force to compress the spring, may be selected so as to prevent a pet from lifting up the actuator and releasing the gate. In embodiments, the spring force may be 5 pounds force or greater, including all values and ranges from 20 pounds force to 100 pounds force, including all values and ranges therein, such as 40 pounds or 60 pounds force.

Figure 6:
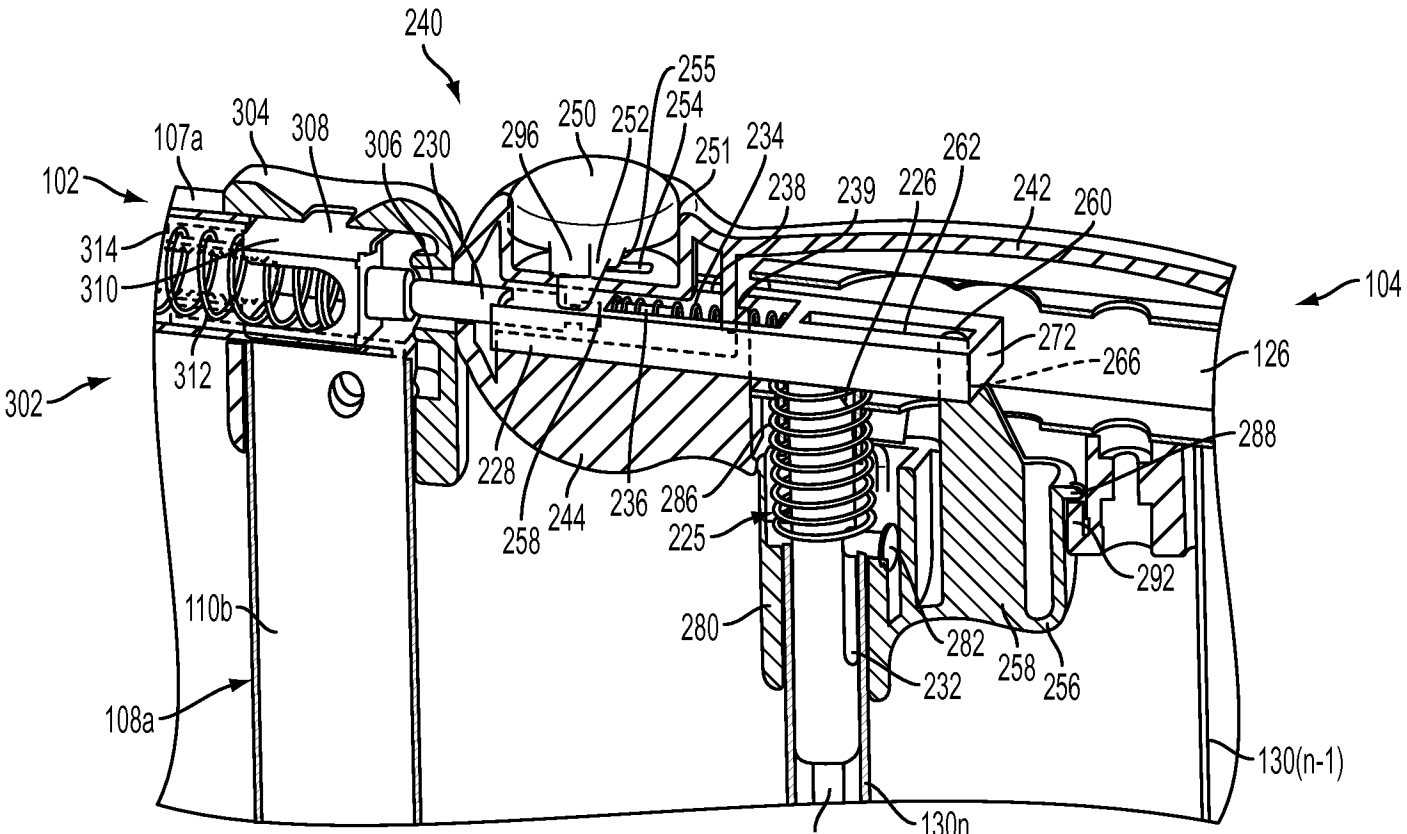
FIG. 6 illustrates an embodiment of a hand actuator with the front portion of the actuator cover removed with the actuator in the neutral position.

FIG. 6 illustrates a hand actuator 240 provided at the upper portion of the gate door 104. The hand actuator 240 may include a cover having an upper portion 242 and a lower portion 244. The hand actuator 240 is secured to the upper gate crossbar 126 and the upper portion of at least one, if not more, door poles 130*n*, 130(*n*−1). As illustrated, a portion of the hand actuator 240 extends past the end of the crossbar 126 and spans between the gate door 104 and the frame 102. However, in other embodiments, the hand actuator may be coextensive only with the gate door 104.

As alluded to above, the drive 206, which is received in the foot actuator 200 (see FIG. 5), extends up and through one of the poles 130*n* in the door 104 and is received in the upper door crossbar 126. This end of the drive 206, the end 225 opposing the retracting pin 214 and foot actuator 200, includes a sloped surface 226. The sloped surface 226 engages a retractable bar 228, described further herein. In addition, near the opposing end 225, the drive 206 includes a slot 232, which extends through the drive 106 transverse to the length of the drive 106.

The retractable bar 228 is at least partially inserted and retained in a horizontally slidable manner in the upper door crossbar 126 and the hand actuator 240. An upper retracting pin 230 extends horizontally from the retractable bar 228, away from the center of the gate, and is received in a catch in the frame 102, described further herein. The retractable bar 228 and the upper retracting pin 230 are biased in the engaged position or latched position by a second bias spring 234. The second bias spring 234 is located in a first opening 238 formed in the retractable bar 228. The second bias spring 234 is retained in position on one side by a post 236 extending from the retractable bar 228 into the opening 238 and at the opposite side by a stationary wall 239 that extends into the opening 238. The stationary wall 239 may be formed by either the upper cover portion 242, the lower cover portion 244, or both. The first opening 238 may assume a number of geometries and may extend vertically at least partially, or completely, through the retractable bar 228.

Thus, the retractable bar 228 may move horizontally back and forth relative to the center of the gate. When the retractable bar 228 is moved toward the center of the gate, the second bias spring 234 may compress against the stationary wall 239. When the hand actuator is released, the spring 234 may expand to its normal position and move the retractable bar 228 away from the center of the gate and extending the upper retracting pin 230 towards the catch. Further, the stationary wall 239 also prevents the retractable bar 228 from falling out of the hand actuator 240 by limiting the forward motion, i.e., the motion of the retractable bar 228 toward the frame 102.

The second bias spring 234 is compressed by actuator button 250. The actuator button 250 is received in a recess 251 the upper portion 242 of the hand actuator 240. The actuator button 250 includes two tabs 252 extending down from the button 250, which have a sloped surface 255 and narrow towards the ends opposing the actuator button 250. While two tabs are illustrated; alternatively, one, three or four tabs may be present. The tabs 252 may pass through slots 254 in the upper cover portion 242 of the hand actuator 240. When depressed, the sloped surfaces 255 of the tabs 252 engage a wall 258 in the retractable bar 228 and pushes the retractable bar 228 further into the upper door crossbar 126 away from the frame 102 and retracting the upper retracting pin 230 from the catch provided in the frame 102.

The hand actuator further includes a actuation lever 256. The actuation lever 256 may move vertically up and down relative to and into the hand actuator 240. The lower cover portion 244 of the hand actuator 240 defines an opening 257 to receive the actuation lever 256. The actuation lever 256 includes a first channel 258 through which the pole 130*n* passes before the pole 130*n* is received in the upper door crossbar 126.

In addition, the actuation lever 256 includes an engagement tab 258 extending upwards into the hand actuator 240. The engagement tab 258 terminates at a finger 260 which extends vertically into a second opening 262 in the retractable bar 228. The second opening 262 is illustrated as extending vertically completely or partially through the retractable bar 228. The base of the finger 264 and end of the engagement tab 258 form a shoulder 266 upon which the retractable bar 228 may rest when the upper retracting pin 230 is fully extended. When the upper retracting pin is forced back by the actuator button 250, the retractable bar 228 may be pushed back such that the shoulder 266 is at least partially coextensive with the second opening 262. The engagement tab, under the shoulder 266, also includes a sloped surface 268, wherein the engagement tab 258 becomes wider towards the base of the engagement tab 270. As the lower actuation lever is pressed and raised into the hand actuator 240, the sloped surface 268 of the engagement tab engages the end wall 272 of the retractable bar and is capable of forcing the retractable bar 228 further back away from the frame 102.

Further, the lower actuation lever 256 includes a ledge 280 surrounding the pole 130*n* through which the drive 206 passes. A pin 282 passes through the slot 232 in the drive 206 and rests on the ledge 280. The pin 282 is retained stationary within (and relative to) the lower actuation lever 256. The drive 206 may be moved by the pin 282, when the lower actuation lever 256 is depressed, i.e., vertically raised. The drive 206 may move relative to the pin 282 when the foot actuator is raised as further described below.

The actuation lever 256 is kept in an extended position relative to the upper gate crossbar 126 by a third bias spring 286, by the weight of the drive 206, or both. The third bias spring 286 is retained between the retractable bar 228 and pin 282. The force for compressing the third bias spring 286 may be in the range of 1 pounds force to 50 pounds force, including all values and ranges therein. Raising of the actuation lever 256 compresses the third bias spring 286 and, when the upward force is removed from the handle, the third bias spring 286 decompresses and returns to its normal position, forcing the actuation lever 256 down.

Finally, the actuation lever 256 includes a stopping shoulder 288. The stopping shoulder 288 is positioned near the upper edge of the lower actuation lever 256. The stopping shoulder is engagable with and rests 288 on a ledge 292 defined by the lower cover portion 244, which prevents the actuation lever from falling out of the bottom of the hand actuator 240. The stopping shoulder 288 may extend around the actuation lever 256 or, as illustrated, at just portions of the actuation lever 256 forming a number of shoulders and the ledge 292 may be at least partially coextensive with the stopping shoulder 288. Further, while the stopping shoulders 288 are illustrated as being in the same plane, they may be at different vertical locations. The stopping shoulders may also act as a guide, particularly, when as illustrated, the shoulders extend around just a portion of the actuator, as they may be fit into guide channels.

The upper portion 302 of one of the vertical members 108*a* of the frame 102 may include a catch 304, which receives the upper retracting pin 230. This vertical member 108*a* opposes the vertical member 108*b* to which the gate door 104 is hingedly affixed. This upper catch 304 is illustrated as forming a cap over the top corner of the vertical member 108*a*. The catch 304 has openings to receive the vertical pole 110*b* and a second opening to receive the upper crossbar 107*a*. The catch 304 also includes an opening 306 to receive the second retracing pin 230.

In embodiments, a visual indicator may be included to indicate whether the gate is opened or closed. The visual indicator may be mounted in the frame and retained between the catch 304 and the upper crossbar 107*a* of the vertical side member. The catch 304 may includes a visual indicator opening 308 for viewing the visual indicator 210, which may slide horizontally back and forth within the upper crossbar 107*a*. When the upper retracting pin 230 is biased away from the center of the gate and inserted into the catch 304, the visual indicator 310 is pushed back into the upper frame crossbar 107*a* and indicates that the gate is closed. When the upper retracting pin 230 is removed from the catch 304 and moved towards the center of the gate, the visual indicator 310 is also pushed forward in the upper frame crossbar 107*a*, toward the center of the gate, by a fourth spring 312 to indicate that the gate is open. The fourth spring 312 being retained between the visual indicator 310 and a stop 314 located in the upper crossbar 107*a*. The stop 314 may be formed by a wall, a screw or a pin. The open and closed indicators may be formed by different colors, text or words placed on the upper portion of the indicator.

Figure 7:
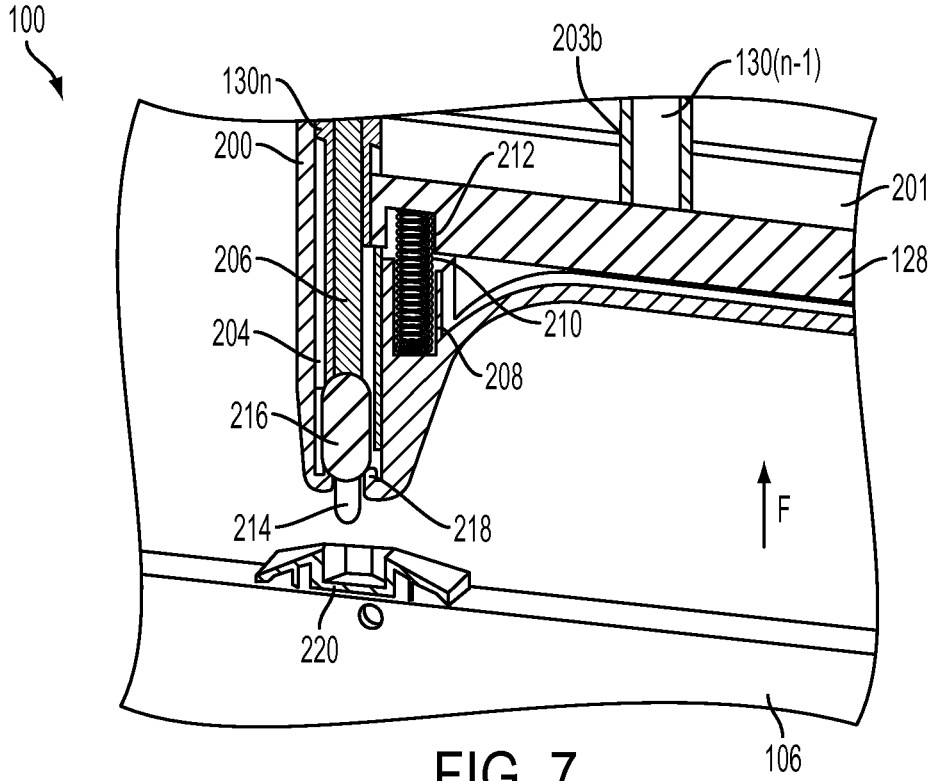
FIG. 7 illustrates the embodiment of the foot actuator of FIG. 5 in the unlatched position.

When the gate 100 is operated with a user's foot, a user may insert their foot between the foot actuator 200 and the lower frame crossbar 106. Referring to FIGS. 5 and 7, the user may raise the foot actuator 200 by raising their foot in the direction of arrow F. The foot actuator 200 may raise the drive 206. For example, the lip 218 provided in the foot actuator 200 may engage the collar 216 on the drive 206, raising the drive 206 as the actuator is raised. The drive is lifted up through pole 130*n* and the lower retracting pin 214 is raised out of the lower catch 220, allowing the lower retracting pin 214 to clear the lower catch 220. As the drive 206 is raised, the first bias spring 210 is compressed between the foot actuator 200 and the lower door crossbar 128.

Figure 8:
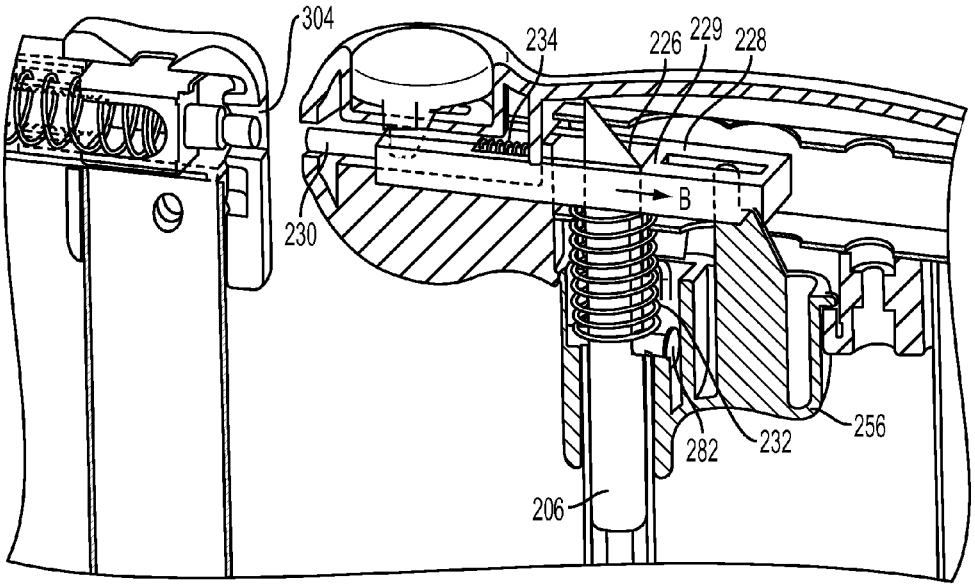
FIG. 8 illustrates the embodiment of the hand actuator of FIG. 6 in the unlatched position due to actuation of the foot actuator.

As the drive 206 is raised upon raising the foot actuator 200, the sloped surface 226 at the opposing end of the drive 225, seen in FIG. 8, engages the retractable bar 228, such as at wall 229. The sloped surface 226 of the drive 206 forces the retractable bar 228 and the upper retracting pin 230 back, in the direction of arrow B, from the frame 102, towards the center of the gate, and out of the upper catch 304. It is noted that, as the drive 206 is raised, the pin 282 and the lower actuation lever 256 may remain stationary. The slot 232 in the drive 206 allows the drive 206 to move relative to the pin 282 without requiring the pin 282 to be moved.

When the user releases the force placed on the foot actuator by their foot, the actuator 200 is forced back down by the first bias spring 210. The actuator 200 may no longer support the drive 206 and the drive may fall under its own weight, forcing the lower retracting pin 214 down into the latched position. As the drive 206 moves downward, the retractable bar 228, no longer forced toward the center of the gate door 104 by the drive 206, may move back away from the center of the gate door under the force of the second bias spring 234 bringing the upper retracting pin 230 with it. The first and upper retracting pins 214 and 230 may thus be extended away from the center of the gate door 104 into the latched position (although, it is noted that if the door is opened when force is released from the foot actuator, the door may not itself be latched).

In embodiments, in order to avoid having to maintain pressure on the foot actuator while the closing the door to keep the retracting pin 214 upward to clear the lower catch 220, biased hinged couplings 120*a*, 120*b* may exert a sufficient amount of force on the door 104 to overcome the spring force extending the retracting pins 214, 230. The retracting pins 214, 230 may be forced back a sufficient amount to clear the catches 220 and 304 and allow the gate to close. The retracting pins 214, 230 may then be then received in the corresponding catch openings retaining the gate door 104 within the frame 102 in the closed position.

Figure 9:
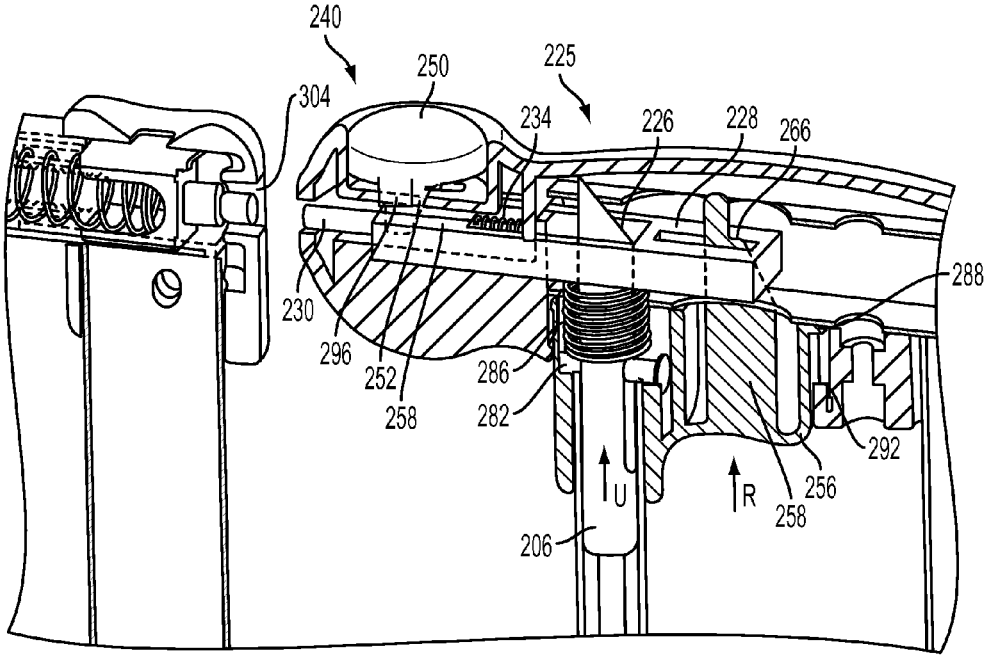
FIG. 9 illustrates the embodiment of the hand actuator of FIG. 6 in the unlatched position due to actuation of the hand actuator.

With reference to FIGS. 6 and 9, a user may open the gate door 104 with their hand by first depressing the actuator button 250 in the hand actuator 240. The button may be depressed with sufficient force to deform the resilient members 296 extending from the bottom of the actuator button. As the actuator button 250 is forced downward, the actuator button tabs 252 engage a surface 258 in the retractable bar 228. The retractable bar 228 with the upper retracting pin 230 is pushed towards the center of the gate releasing the upper retracting pin 230 from the catch 304. This compresses the second bias spring 234 and may cause the second opening defined in the retractable bar 228 to shift past the shoulder 266 of the lower actuation lever 256.

The actuation lever 256 may then be depressed and raised, at least partially, into the hand actuator 240. As the actuation lever 256 is raised in direction of arrow R, the sloped surface of the engagement tab 258 may optionally engage the retractable bar 228 and move the retractable bar further towards the center of the gate door 104. In addition, as the actuation lever 256 may engage the drive 206. When the actuation lever 256 is raised, the pin 282 seated on the ledge 280 in the actuation lever 256 is raised. The pin 282 engages the drive 206 in slot 232 and the drive 206 raising the drive 206. This lifts the lower retracting pin 214 out of the lower catch 220 located at the bottom of the frame. Further, raising of the actuation lever 256 and pin 282 compresses third bias spring 286. As both the first and upper retracting pins 214, 230 are now retracted out of their respective catches 220, 304 the gate door 104 may swing in the frame 102.

When the actuation lever 256 is released, the third bias spring 286, along with the weight of the drive 206, may force the actuation lever 256 down, lowering pin 282. This may allow the drive 206 to drop under its own weight causing the lower retracting pin 214 to move away from the center of the gate door 204 and extend out. Lowering of the drive 206, the actuation lever 256, or both, may allow the retractable bar 228 to move away from the center of the gate under the force of the second bias spring 234. The causes the upper retracting pin 230 to move away from the center of the gate and extend out. The resilient members 296 of the actuator button 250 may then recover forcing the actuator button back up.

It is also contemplated that either the first or upper retracting pin need not be provided. For example, in embodiments where the portion of the lower frame crossbar 106 located between the vertical side members is removed, the lower retracting pin need not be present. However, the presence of both retracting pins may improve stability of the gate door 104 in the frame 102 when a pet, or person, pushes against the gate door 104.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A pet gate, comprising:

a frame including a first vertical side member and a second vertical side member;

a door pivotally mounted to said second vertical side member, wherein said door includes a pole extending between an upper door crossbar and a lower door crossbar, and said door pivots between an open position and a closed position;

a foot actuator mounted to said door, wherein said foot actuator is vertically slidable between a raised position and a lowered position;

a first channel provided in said foot actuator, wherein said first channel aligns with said pole;

a drive passing through said pole and received in said first channel, wherein said drive is raise-able by said foot actuator;

a retractable bar slidably provided in said upper door crossbar, wherein said drive engages said retractable bar when said drive is raised; and an upper retracting pin extending from said retractable bar, wherein said upper retracting pin is receivable in a upper catch provided on said first vertical member.

2. The pet gate of claim 1, further comprising a first bias spring retained between said foot actuator and said lower door crossbar.

3. The pet gate of claim 1, wherein said drive further comprises a collar and said foot actuator comprises a cover that includes a lip, wherein said lip at least partially coextensive with said collar and said lip engages said collar when said foot actuator is raised.

4. The pet gate of claim 1, wherein said frame includes a lower frame crossbar spanning between said first vertical member and said second vertical member and said lower frame crossbar includes a lower catch and said drive includes a lower retracting pin receivable in said lower catch.

5. The pet gate of claim 1, further comprising a hand actuator affixed to said door, wherein said hand actuator includes a hand actuator cover having an upper cover portion and a lower cover portion, and a portion of said retractable bar is retained in said hand actuator.

6. The pet gate of claim 5, wherein said hand actuator spans said door and said first vertical member when said door is in said closed position.

7. The pet gate of claim 5, wherein said hand actuator includes an actuator button and said actuator button includes a tab extending through said upper cover portion, wherein said tab engages said retractable bar and slides said retractable bar away from said first vertical member when said actuator button is depressed.

8. The pet gate of claim 7, wherein said actuator button further includes a resilient member extending from the underside of said actuator button.

9. The pet gate of claim 7, further comprising a second bias spring retained between said retractable bar and said hand actuator cover.

10. The pet gate of claim 5, wherein said hand actuator includes an actuation lever, wherein said actuation lever engages said drive when said actuation lever is raised.

11. The pet gate of claim 10, wherein said drive includes a slot and said actuation lever includes a pin and said pin engages said drive when said actuation lever is raised.

12. The pet gate of claim 10, further comprising a third bias spring retained between said pin and said retractable bar.

13. The pet gate of claim 10, wherein said actuation lever includes an engagement tab extending therefrom, wherein said engagement tab engages said retractable bar and slides said retractable bar away from said first vertical member.

14. The pet gate of claim 10, wherein said actuation lever includes a stopping shoulder and said hand actuator includes a ledge, wherein said stopping shoulder is engagable with said ledge.

15. The pet gate of claim 1, wherein said first vertical member includes a visual indicator slidably positioned therein and said first catch includes visual indicator opening to expose a portion of said visual indicator.

16. The pet gate of claim 1, wherein said drive exhibits a weight in the range of 1 ounce to 30 pounds.

17. A method of opening a gate comprising:

raising a foot actuator slidably mounted to a door, wherein said foot actuator is vertically slidable between a raised position and a lowered position and said foot actuator includes a first channel and said door comprises a pole extending between an upper crossbar and a lower crossbar and said first channel aligns with said pole, wherein said door is pivotably mounted to a second vertical member of a frame including a first vertical member and said second vertical member, wherein said door pivots between an open position and a closed position;

engaging a drive received in said first channel with said foot actuator and raising said drive, wherein said drive extends through said pole;

sliding a retractable bar away from said first vertical member with said drive, wherein said retractable bar is slidably provided in said upper crossbar and said retractable bar includes an upper retracting pin;

removing said upper retracting pin from an upper catch in said first vertical member; and pivoting said door relative to said second vertical member.

18. The method of claim 17, wherein said drive includes a lower retracting pin and said method further comprises raising said lower retracting pin out of a lower catch in said frame.

* * * * *